US012674254B2

(12) United States Patent
Yasuda et al.

(10) Patent No.: US 12,674,254 B2
(45) Date of Patent: Jul. 7, 2026

(54) MULTILAYER STRUCTURED SPUN YARN, METHOD FOR PRODUCING THE SAME, FABRIC, AND CLOTHING

(71) Applicant: THE JAPAN WOOL TEXTILE CO., LTD., Kobe (JP)

(72) Inventors: Tomonori Yasuda, Gifu (JP); Takayuki Okabe, Gifu (JP); Hideaki Mogami, Gifu (JP)

(73) Assignee: The Japan Wool Textile Co., Ltd., Hyogo (JP)

( * ) Notice: Subject to any disclaimer, the term of this patent is extended or adjusted under 35 U.S.C. 154(b) by 272 days.

(21) Appl. No.: 18/261,215

(22) PCT Filed: Jul. 11, 2022

(86) PCT No.: PCT/JP2022/027224
§ 371 (c)(1),
(2) Date: Jul. 12, 2023

(87) PCT Pub. No.: WO2024/013792
PCT Pub. Date: Jan. 18, 2024

(65) Prior Publication Data
US 2024/0279849 A1 Aug. 22, 2024

(51) Int. Cl.
*D02G 3/32* (2006.01)
*D02G 3/04* (2006.01)
*D02G 3/26* (2006.01)

(52) U.S. Cl.
CPC ..... *D02G 3/32* (2013.01); *D02G 3/04* (2013.01); *D02G 3/26* (2013.01); *D10B 2331/04* (2013.01)

(58) Field of Classification Search
None
See application file for complete search history.

(56) References Cited

U.S. PATENT DOCUMENTS 3,978,267 A 8/1976 Selwood
4,069,656 A * 1/1978 Arai ..... D02G 3/38 57/328

(Continued)

FOREIGN PATENT DOCUMENTS

AU 682320 B2 * 10/1997 ..... D02G 3/24
CN 1094528 11/2002

(Continued)

OTHER PUBLICATIONS

USPTO STIC translation of JPH0345734 (Year: 1991).*

(Continued)

*Primary Examiner* — Grace Huang
(74) *Attorney, Agent, or Firm* — HSML P.C.

(57) ABSTRACT

A multilayer structured spun yarn includes core component fibers as an elastic multifilament yarn and sheath component fibers with inner and outer layer fibers. The inner layer fibers of the sheath component fibers are untwisted, and entirely bundled by the outer layer fibers wound therearound in one direction. The sheath component fibers are blended fibers containing animal hair fibers and short fibers other than animal hair fibers, and a blending proportion of the animal hair fibers is 5 to 50 mass % with respect to 100 mass % of the multilayer structured spun yarn. The multilayer structured spun yarn can produce a fabric in which abrasion resistance, weft elasticity, and anti-pilling properties are improved, a method for producing the same, a fabric, and clothing.

5 Claims, 6 Drawing Sheets

(56) References Cited

U.S. PATENT DOCUMENTS

| | | | | |
|---|---|---|---|---|
| 4,912,781 | A | 4/1990 | Robins et al. | |
| 5,103,626 | A | 4/1992 | Morrison | |
| 5,749,212 | A * | 5/1998 | Rees | D02G 3/324 57/224 |
| 6,405,519 | B1 * | 6/2002 | Shaikh | D02G 3/281 57/328 |
| 6,606,846 | B2 * | 8/2003 | Land | D03D 15/513 57/244 |
| 7,155,891 | B2 * | 1/2007 | Bader | D02G 3/367 57/210 |
| 7,310,932 | B2 * | 12/2007 | Liao | D03D 15/56 57/224 |
| 7,841,162 | B2 * | 11/2010 | Coombs | D02G 3/38 57/224 |
| 9,642,399 | B2 * | 5/2017 | Baba | A41D 1/00 |
| 11,773,515 | B2 | 10/2023 | Estreicher et al. | |
| 12,344,968 | B2 | 7/2025 | Izawa | |
| 2002/0098354 | A1 | 7/2002 | Land | |
| 2002/0127939 | A1 * | 9/2002 | Hwo | D01F 8/14 428/374 |
| 2003/0074879 | A1 * | 4/2003 | Patrick | D02G 3/12 57/210 |
| 2004/0175542 | A1 * | 9/2004 | Miyasaka | D03D 15/283 442/364 |
| 2012/0137649 | A1 | 6/2012 | Kochmann | |
| 2015/0176160 | A1 | 6/2015 | Lee et al. | |
| 2015/0368859 | A1 * | 12/2015 | Nishimura | D07B 1/0693 305/170 |
| 2021/0381141 | A1 * | 12/2021 | Ogata | D02G 3/24 |
| 2023/0313861 | A1 * | 10/2023 | Yoshimura | D06M 15/41 474/268 |
| 2024/0279849 | A1 | 8/2024 | Yasuda et al. | |
| 2024/0352629 | A1 | 10/2024 | Konukoglu et al. | |

FOREIGN PATENT DOCUMENTS

| | | | | |
|---|---|---|---|---|
| CN | 110438797 | | 11/2019 | |
| CN | 110603351 | | 12/2019 | |
| CN | 111893612 | | 11/2020 | |
| CN | 112899839 | | 6/2021 | |
| CN | 113005580 | | 6/2021 | |
| CN | 213538222 | U | 6/2021 | |
| CN | 222251222 | U * | 12/2024 | D03D 13/00 |
| EP | 3 109 351 | | 12/2016 | |
| JP | 2-014033 | | 1/1990 | |
| JP | 3-045734 | | 2/1991 | |
| JP | 03045734 | A * | 2/1991 | D02G 3/32 |
| JP | 6-057547 | | 3/1994 | |
| JP | 8-158184 | | 6/1996 | |
| JP | 2616411 | B | 6/1997 | |
| JP | 2806380 | B | 9/1998 | |
| JP | 11-217741 | | 8/1999 | |
| JP | 2005-042206 | | 2/2005 | |
| JP | 2006-132038 | | 5/2006 | |
| JP | 2008-174848 | | 7/2008 | |
| JP | 2009-293136 | | 12/2009 | |
| JP | 2012-102445 | | 5/2012 | |
| JP | 2015-045112 | | 3/2015 | |
| JP | 2015-196928 | | 11/2015 | |
| JP | 5972420 | B | 8/2016 | |
| JP | 6303077 | B | 3/2018 | |
| JP | 6599496 | B | 10/2019 | |
| JP | 6696004 | B | 5/2020 | |
| KR | 10-2012-0058419 | | 6/2012 | |
| WO | 2018/127991 | | 7/2018 | |
| WO | WO-2018127991 | A1 * | 7/2018 | D03D 15/283 |
| WO | 2019/044910 | | 3/2019 | |

OTHER PUBLICATIONS

"Yarn Count Converter." Offtree. Jun. 9, 2025. https://www.offtree.co.uk/yarn-count-converter/ (Year: 2025).*

STIC Translation of JPH0345734 (Year: 2025).*

Extended European Search Report issued in European Patent Application No. 22910431.0, Dec. 17, 2025, 9 pages.

Extended European Search Report issued in corresponding European Patent Application No. 22922527.1, Oct. 14, 2024.

International Search Report issued in International Application No. PCT/JP2022/027224, Sep. 6, 2022, 3 pages.

"Yarn Count Converter", Offtree, Jun. 9, 2025, https://www.offtree.co.uk/yarn-count-converter/.

1st Office Action issued in Chinese application No. 202280027823.6 dated Jul. 29, 2025 together with its Machine English translation.

1st Office Action issued in European application No. 22922527.1 dated Jul. 14, 2025.

New Spinning Technology: Edited by Wang Jiankun and Zhang Shujie, 1st edition, China Textile Press, 2019, pp. 152-154 w/English translation.

Office Action issued in corresponding Chinese Patent Application No. 202280014552.0, Feb. 4, 2026, 18 pages w/ translation.

* cited by examiner

MULTILAYER STRUCTURED SPUN YARN, METHOD FOR PRODUCING THE SAME, FABRIC, AND CLOTHING

TECHNICAL FIELD

The present invention relates to a multilayer structured spun yarn in which core component fibers are constituted by filament yarns and sheath component fibers are constituted by short blended fibers containing animal hair fibers, a method for producing the same, a fabric, and clothing.

BACKGROUND ART

Various long-short composite spun yarns in which core component fibers are constituted by filament yarns and sheath component fibers are constituted by short fibers have been conventionally proposed because advantages of both the filament yarns and the short fibers can be utilized. Patent Document 1 has proposed a method for producing a long-short composite spun yarn with a uniform mixed fiber structure, by electrically opening a multifilament yarn and twisting it with short fibers using a ring spinning method. Patent Document 2 has proposed a long-short composite spun yarn in which a filament yarn constituted by a conjugated composite fiber yarn is disposed in a core portion thereof and short fibers are arranged in a sheath portion thereof using a ring spinning method. The inventors of the present invention have proposed a long-short composite spun yarn in which a false-twisted multifilament yarn is disposed in a core portion thereof and a short fiber bundle is disposed in a sheath portion thereof using a ring spinning method (Patent Document 3). Patent Document 4 has proposed a long-short composite spun yarn using a fasciated spinning method.

CITATION LIST

Patent Documents

Patent Document 1: JP 2012-102445A
Patent Document 2: JP 2015-045112A
Patent Document 3: Japanese Patent No. 6696004
Patent Document 4: JP H11-217741A

DISCLOSURE OF INVENTION

Problem to be Solved by the Invention

However, these conventional techniques have issues regarding the yarn structure and the animal hair fiber blending proportion, and further have issues regarding the abrasion resistance, the weft elasticity, and the anti-pilling properties, when the yarn is formed into a fabric.

In order to solve the above-mentioned conventional issues, the present invention provides a multilayer structured spun yarn in which the yarn structure and the animal hair fiber blending proportion are optimized and, when the yarn is formed into a fabric, the abrasion resistance, the weft elasticity, and the anti-pilling properties are improved, a method for producing the same, a fabric, and clothing.

Means for Solving Problem

The present invention is directed to a multilayer structured spun yarn including: core component fibers; and sheath component fibers including inner layer fibers and outer layer fibers, wherein the inner layer fibers of the sheath component fibers are untwisted, and entirely bundled by the outer layer fibers wound therearound in one direction. The core component fibers are an elastic multifilament yarn. The sheath component fibers are blended fibers containing animal hair fibers and short fibers other than animal hair fibers, and a blending proportion of the animal hair fibers is 5 to 50 mass % with respect to 100 mass % of the multilayer structured spun yarn.

The present invention is directed to a method for producing the above-described multilayer structured spun yarn, including: supplying a sliver of blended fibers containing animal hair fibers and short fibers other than animal hair fibers and serving as sheath component fibers, to a draft zone, and drafting the sliver; supplying an elastic multifilament yarn serving as core component fibers to a point on the upstream side of front rollers in the draft zone, and combining the elastic multifilament yarn with the sliver to form a fiber bundle; and supplying the fiber bundle to a spindle disposed at a distance from a discharge portion of the front rollers, false-twisting the fiber bundle using a swirling flow, and then taking up the fiber bundle.

The present invention is directed to a fabric using the above-described multilayer structured spun yarn. Also, the present invention is directed to clothing containing the above-described multilayer structured spun yarn or the above-described fabric.

Effects of the Invention

The present invention can provide a multilayer structured spun yarn in which the yarn structure and the animal hair fiber blending proportion are optimized and, when the yarn is formed into a fabric, the abrasion resistance, the weft elasticity, and the anti-pilling properties are improved, a method for producing the same, a fabric, and clothing. These properties are suitable for business suits, business uniforms, school uniforms, and the like. Since the method for producing a multilayer structured spun yarn of the present invention is a fasciated spinning method, a yarn can be spun at a speed about 10 to 20 times faster than the ring spinning method, efficiently, reasonably, and at a low cost. Furthermore, the provided multilayer structured spun yarn is uniform with fewer fluff counts and has a high hot water shrinkage rate.

DESCRIPTION OF THE INVENTION

Figure 1:
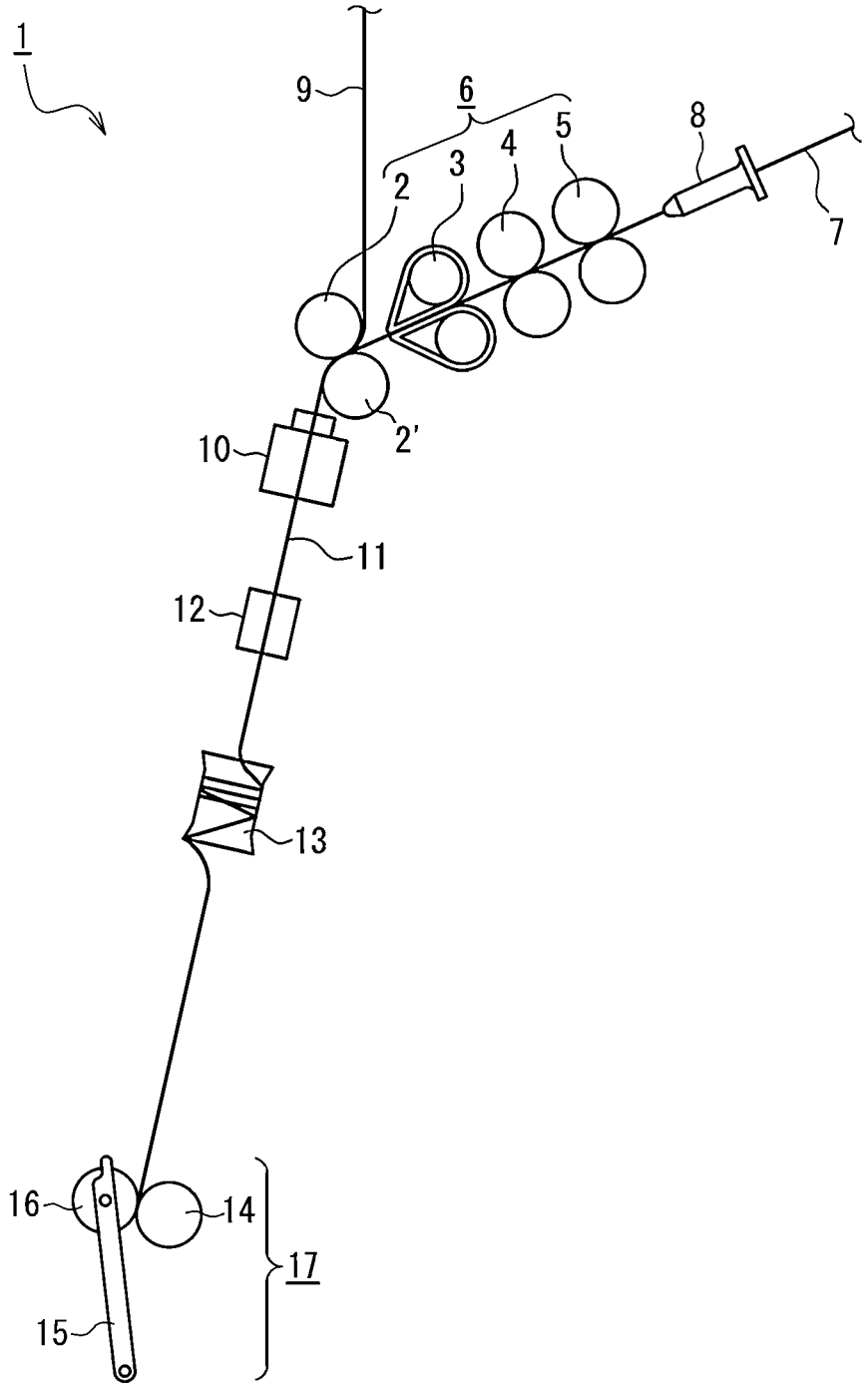
FIG. 1 is a schematic perspective view showing the main portion of a fasciated spinning apparatus for producing a core-sheath structured spun yarn according to an embodiment of the present invention.

The multilayer structured spun yarn of the present invention includes core component fibers and sheath component fibers, the sheath component fibers including inner layer fibers and outer layer fibers. That is, this yarn has a three-layer structure. This strengthens the yarn structure and improves the abrasion resistance and the anti-pilling properties when the yarn is formed into a fabric. Also, this yarn structure prevents an elastic multifilament yarn serving as the core component fibers from projecting outward even when the multilayer structured spun yarn or fabric is hot-water shrunk in the subsequent process, thereby suppressing snarling.

The core component fibers are an elastic multifilament yarn. The elastic multifilament yarn is preferably a conjugated multifilament yarn or a false-twisted multifilament yarn. This improves the weft elasticity of the fabric. The conjugated multifilament yarn is preferably a polyester conjugated filament yarn obtained through side-by-side composite spinning of polyethylene terephthalate (PET) and polytrimethylene terephthalate (PTT), for example. Examples of such an elastic yarn include a yarn with the product name "Lycra T400 Fiber" (available from Toray Opelontex Co., Ltd.). Other types of elastic yarns that can be used include conjugated yarns of polyethylene terephthalate of two components with different extreme viscosities, conjugated yarns of PET and polybutylene terephthalate (PBT), and conjugated yarns of PTT and PBT. Such polyester conjugated filament yarns have high chlorine and light resistance as with PET multifilament yarns. Conjugated multifilament yarns are crimped and become elastic (stretchable) when treated with hot water at about the same temperature as the dyeing temperature. This is why they are also called latently crimpable yarns.

The false-twisted multifilament yarn is preferably a false-twisted multifilament polyester yarn, a false-twisted multifilament nylon yarn, a false-twisted multifilament cellulose acetate yarn, a false-twisted multifilament cupra yarn, a false-twisted multifilament silk yarn, or the like. These yarns can be combined with animal hair fibers to produce higher value-added twisted union yarns. In particular, a false-twisted multifilament polyethylene terephthalate yarn is preferable because of its high strength and elasticity.

The sheath component fibers are constituted by a blend of fibers containing animal hair fibers and short fibers other than animal hair fibers. In the sheath component fibers, the short fibers located in the inner layer are untwisted, and entirely bundled by the short fibers located in the outer layer wound therearound so as to be true-twisted in one direction. The untwisted short fibers in the inner layer and the true-twisted fibers located in the outer layer may be different fibers, or the same fibers that are to be interchanged by migration.

Examples of the animal hair fibers that can be used include wool (sheep fur) (with a fiber length of 30 to 150 mm for merino wool), mohair (goat hair) (with a fiber length of 100 to 300 mm), cashmere (with a fiber length of 40 to 90 mm), camel (camel hair) (with a fiber length of 50 to 70 mm), alpaca (with a fiber length of 100 to 200 mm), vicuna (with a fiber length of 20 to 70 mm), and angora rabbit (rabbit fur) (with a fiber length of 100 to 130 mm). Of these animal hair fibers, wool is preferable because it is the most versatile. Wool may be blended with other animal hair fibers. The animal hair fibers are preferably cut to have an average fiber length of 20 to 35 mm. The blending proportion of the animal hair fibers is 5 to 50 mass % with respect to 100 mass % of the multilayer structured spun yarn. The blending proportion of the animal hair fibers is preferably 7 to 45 mass %, and more preferably 10 to 40 mass %. This produces warm woven and knitted fabrics with a good texture.

The sheath component fibers are obtained by blending animal hair fibers and short fibers other than animal hair fibers. The short fibers other than animal hair fibers may be any of synthetic fibers, regenerated fibers, and natural fibers. The short fibers are preferably short polyester fibers, short nylon fibers, short cellulose acetate fibers, short cupra fibers, short silk fibers, cotton fibers, hemp fibers, rayon fibers, or the like. Of these short fibers, short polyester fibers are preferable because of their high strength and elasticity. The short fibers other than animal hair fibers are preferably cut to have an average fiber length of 20 to 51 mm.

The multilayer structured spun yarn preferably contains 10 to 40 mass % of the elastic multifilament yarn of the core component fibers and 60 to 90 mass % of the sheath component fibers with respect to 100 mass % of the multilayer structured spun yarn. The multilayer structured spun yarn more preferably contains 15 to 35 mass % of the elastic multifilament yarn of the core component fibers and 65 to 85 mass % of the sheath component fibers, and even more preferably contains 20 to 30 mass % of the elastic multifilament yarn of the core component fibers and 70 to 80 mass % of the sheath component fibers.

The multilayer structured spun yarn of the present invention is preferably a fasciated spun yarn because of its excellent productivity. A fasciated spun yarn is about 10 to 20 times more productive than a ring spun yarn. In particular, a fasciated spun yarn produced using a fasciated spinning apparatus with a single swirl nozzle has less fluff and a stronger yarn structure, which improves the abrasion resistance and the anti-pilling properties when the yarn is formed into a fabric. The fasciated spinning is also referred to as Vortex spinning.

The multilayer structured spun yarn of the present invention preferably has a metric count (single yarn) in the range of 20 to 52 yarn count (fineness: 500 to 192 decitex). The yarn with a metric count in this range is suitable for business suits, business uniforms, school uniforms, and the like. The multilayer structured spun yarn may be a two ply yarn obtained by twisting two yarns together. The two ply yarn preferably has a metric count of 10 to 26 yarn count (fineness: 1000 to 384 decitex). The two ply yarn gives the fabric a superior surface and also increases the strength of the woven fabric.

The woven or knitted fabric of the present invention preferably has a mass per unit area in the range of 50 to 400 $g/m^2$. The mass in this range makes it possible to produce clothing that is lighter and more comfortable to wear. The mass is more preferably in the range of 100 to 350 $g/m^2$, and even more preferably in the range of 150 to 300 $g/m^2$. The woven fabric structure may be any structure such as plain weave, twill weave, satin weave, or other types of derivative weave. The knitted fabric is obtained through weft knitting, circular knitting, warp knitting, or the like, and the knitted fabric structure may be any structure.

Next, an apparatus and a method for producing a core-sheath structured yarn according to the present invention will be described with reference to the drawing. In the following drawing, the same reference numerals denote the same constituent elements. FIG. 1 is a perspective view showing the main portion of a fasciated spinning apparatus 1 according to an embodiment of the present invention.

(1) Drafting Process

A draft zone 6 of the fasciated spinning apparatus 1 is constituted by a pair of front rollers 2 and 2', a pair of second rollers 3 with aprons, a pair of third rollers 4, and a pair of back rollers 5. A sliver 7 obtained by blending animal hair fibers and short fibers other than animal hair fibers and serving as the sheath component fibers passes through a sliver guide 8 and is supplied from the back rollers 5 so as to be drafted in the draft zone 6.

(2) Combining Process of Core Component Fibers and Coating Component Fibers

An elastic multifilament yarn 9 serving as core component fibers is supplied to a point before (on the upstream side of) the front rollers 2 and 2' in the draft zone 6, and combined with a fiber bundle obtained by drafting the sliver 7.

(3) Spun Yarn Forming Process

The combined fiber bundle of the core component fiber yarn and the sheath component fibers is supplied to a spindle 10 disposed at a distance from the discharge portion of the front rollers 2 and 2', and false-twisted by a swirling flow to form a multilayer structured spun yarn 11.

(4) Take-Up Process

The obtained multilayer structured spun yarn 11 passes through a slub catcher 12, is received by a friction roller 13, and is taken up by a package 16 that is driven by a take-up drum 14 of a winding portion 17 and supported on a cradle arm 15.

The spinning machine used in the production method of the present invention is available under the product name "Murata Vortex Spinner" manufactured by Murata Machinery, Ltd., for example. This machine is characterized by having a yarn speed of 300 to 450 m/min, that is, having a production speed that is about 10 to 20 times faster than that of a ring spinning machine.

Figure 2:
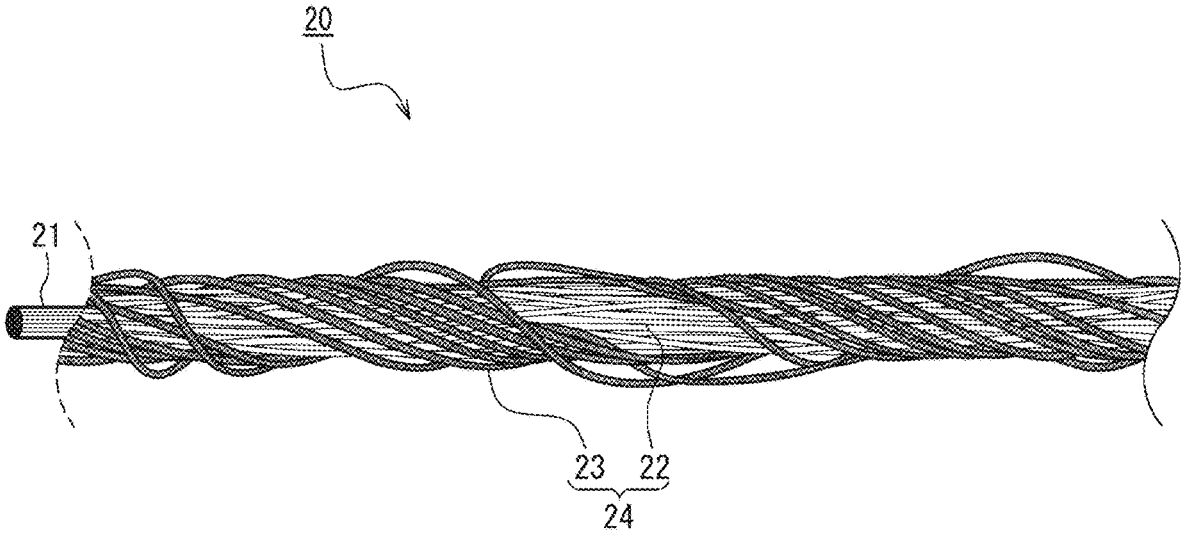
FIG. 2 is a schematic perspective view of the core-sheath structured spun yarn according to the embodiment of the present invention.

FIG. 2 shows a multilayer structured spun yarn (fasciated spun yarn) 20 according to an example of the present invention. This example shows a case in which the blending proportion of wool is set to 15 mass % with respect to 100 mass % of the multilayer structured spun yarn. Core component fibers 21 are an elastic multifilament yarn, and sheath component fibers 24 are blended fibers of wool and short polyester (PET) fibers. The wool is predominantly contained in inner layer fibers 22 and is untwisted. The short PET fibers are predominantly contained in wound fibers 23 in the outer layer. The wound fibers 23 in the outer layer are true-twisted in one direction and entirely bundle the fibers. Accordingly, there is little fluffing or sagging, and the fibers are not detached even when subjected to abrasion, and thus a strong yarn state is maintained. In the description above, the "one direction" refers to wound fibers being S-twisted or Z-twisted, and does not mean that the twist angle is the same. Whether wound fibers are S-twisted or Z-twisted is determined by the direction of the pressurized swirl flow of the spinner of the fasciated spinning machine. This multilayer structured spun yarn (fasciated spun yarn) 20 has a three-layer structure constituted by the core component fibers 21, and the untwisted inner layer fibers 22 and the wound fibers 23 in the outer layer that are included in the sheath component fibers 24. This yarn structure provides high yarn strength. Furthermore, wool in the inner layer is coated and protected by short PET fibers in the outer layer, which prevents damage to the wool.

Figure 3:
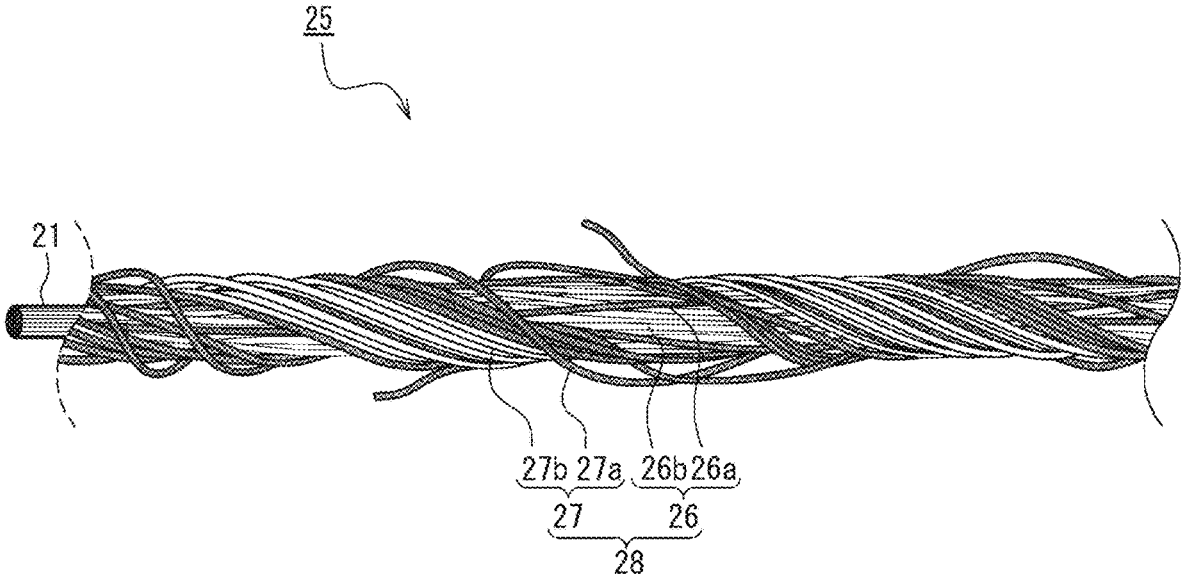
FIG. 3 is a schematic perspective view of a core-sheath structured spun yarn according to another embodiment of the present invention.

FIG. 3 shows a multilayer structured spun yarn (fasciated spun yarn) 25 according to another example of the present invention. This example shows a case in which the blending proportion of wool is set to 35 mass % with respect to 100 mass % of the multilayer structured spun yarn 25. This example is different from that in FIG. 2, in that inner layer fibers 26 and wound fibers 27 in the outer layer serving as sheath component fibers 28 that are arranged as with the inner layer fibers 22 and the wound fibers 23 in the outer layer are both in a state of blended fibers of wool and short PET fibers. In the drawing, **26*b* denotes wool in the inner layer, 26*a* denotes short PET fibers in the inner layer, 27*b* denotes wool in the outer layer, and 27*a*** denotes short PET fibers in the outer layer. This multilayer structured spun yarn also has a high yarn strength due to its three-layer structure. Furthermore, the wound fibers in the outer layer are constituted by the wool and the short PET fibers tightly intertwined with each other, which prevents damage to the wool.

Figure 4:
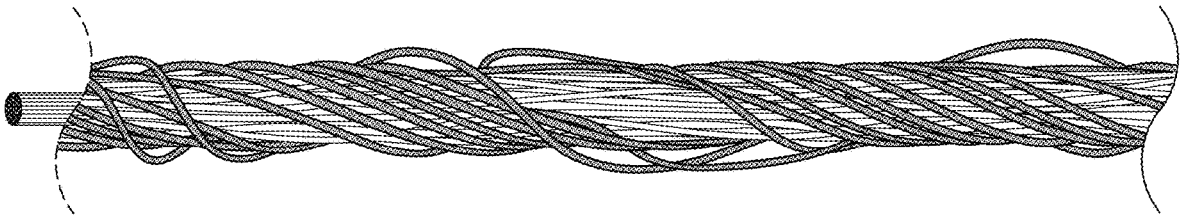
FIG. 4 is a photo (200× magnification) of the core-sheath structured spun yarn as viewed from a side according to the embodiment of the present invention.

FIG. 4 is a photo (200× magnification) of a core-sheath structured spun yarn as viewed from a side according to an embodiment of the present invention, in which the blending proportion of wool is set to 15 mass % with respect to 100 mass % of the multilayer structured spun yarn.

Figure 5:
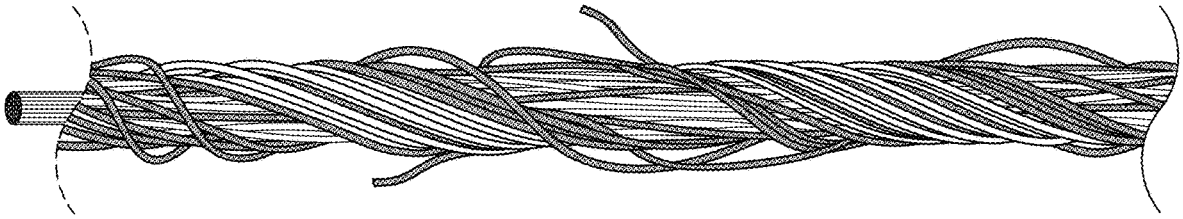
FIG. 5 is a photo (200× magnification) of the core-sheath structured spun yarn as viewed from a side according to the other embodiment of the present invention.

FIG. 5 is a photo (200× magnification) of a core-sheath structured spun yarn as viewed from a side according to another embodiment of the present invention, in which the blending proportion of wool is set to 35 mass % with respect to 100 mass % of the multilayer structured spun yarn.

It can be generally said from FIGS. 2 to 5 that the wound fibers in the outer layer are tightly wrapped around the core component fibers and the inner layer fibers of the sheath component, which contributes to improvements in the abrasion resistance, the weft elasticity, and the anti-pilling properties, when the yarn is formed into a fabric.

Figure 6:
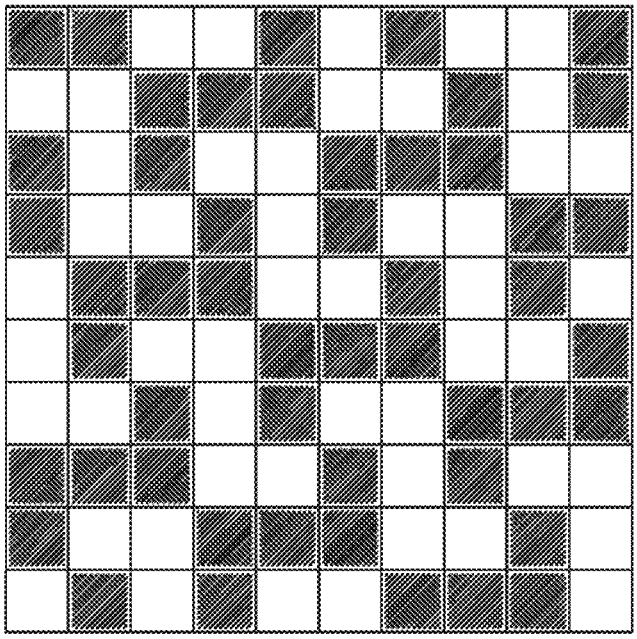
FIG. 6 is a woven structure diagram of a woven fabric according to the embodiment of the present invention.

FIG. 6 is a woven fabric structure diagram of a barathea structure according to an embodiment of the present invention. This structure is obtained by using one type of yarn as the warp yarn and alternately weaving two types of yarns as the weft yarn. The fabric is also referred to as a variable mat woven fabric.

EXAMPLES

Hereinafter, the present invention will be described in more detail by way of the examples. The invention is not limited to the following examples.

The measuring methods in the examples and the comparative examples of the present invention are in conformity with JIS or industry standards.

Examples 1 and 2

1. Fibers Used (1) Core Component Fibers

Polyethylene terephthalate (PET) and polytrimethylene terephthalate (PTT) were subjected to side-by-side composite spinning in a ratio of 50:50 to form a polyester conjugated filament yarn (the product name: Lycra T400 Fiber (available from Toray Opelontex Co., Ltd.), the total fineness: 83 decitex, the number of constituent fibers: 34, black dope dyed product), which was used as the core component fibers.

(2) Sheath Component Fibers

The following two types of fibers were blended.

(i) Wool

A fiber bundle (20 g/m) of merino wool with an average diameter of 22 μm and an average fiber length of 80 mm was square-cut to have an average fiber length of 28 mm.

(ii) Short PET Fibers

Black dope dyed fibers made of polyethylene terephthalate (PET) with a fineness of 1.56 decitex were square-cut (to have an average fiber length of 38 mm).

These wool and short PET fibers were uniformly blended in the specified proportions shown in Table 1.

2. Production of Multilayer Structured Spun Yarn

A multilayer structured fasciated spun yarn was produced from the polyester conjugated filament yarn as the core component fibers and the fiber bundle (sliver) obtained by blending wool and short PET fibers as the sheath component fibers, at a speed of 300 m/min using a machine with the product name "No. 870, Murata Vortex Spinner" manufactured by Murata Machinery, Ltd. shown in FIG. 1, according to the method shown in FIG. 1. The proportions of the fibers are as shown in Table 1. The metric count of the obtained yarn was 36 yarn count (278 decitex). This yarn is indicated as 1/36 when used as a single yarn.

Example 3

A multilayer structured fasciated spun yarn was produced in the same way as that of Example 2, except that the metric count was set to 40 yarn count (250 decitex). This yarn is indicated as 1/40 when used as a single yarn.

Comparative Example 1

Ring spun yarns with a metric count of 60 yarn count (167 decitex) and polyester conjugated filament yarns obtained through side-by-side composite spinning of PET and PTT in a ratio of 50:50 (the product name: Lycra T400 Fiber (available from Toray Opelontex Co., Ltd.), the total fineness: 83 decitex, the number of constituent fibers: 34, black dope dyed product) were twisted together in a twisting machine to produce a twisted union yarn. The proportions of the fibers are as shown in Table 1. The metric count of this yarn was about 40 yarn count (250 decitex).

The above-mentioned conditions and results are summarized in Table 1. In Table 1, the shrinkage rate (%) after hot water treatment is determined by the following formula. The hot water treatment was performed by immersing a yarn in hot water at 100° C. for 20 minutes.

$$\text{Hot water shrinkage rate (\%)} = [(L1-L2)/L1] \times 100$$

L1: Yarn length before hot water treatment
L2: Yarn length after hot water treatment As is clear from Table 1, the multilayer structured spun yarns (fasciated spun yarns) of Examples 1 to 3 were more uniform with fewer fluff counts of 1 mm or longer and had higher hot water shrinkage rates compared with those of the twisted union yarn of Comparative Example 1.

Example 4

The following yarns were used to produce a woven fabric.

(1) Weft Yarn 1

The multilayer structured spun yarn of Example 3 was used.

(2) Weft Yarn 2

The blend sliver of wool and short PET fibers used for the sheath component fibers of Example 1 was used to produce a fasciated spun yarn using the same spinning apparatus as that in Example 1. This fasciated spun yarn contained 30 mass % of wool and 70 mass % of short PET fibers and had a metric count of 40 yarn count (250 decitex).

(3) Warp Yarn

A ring spun two ply yarn with the same mass ratio as that of the above-mentioned weft yarn 2 and a metric count of 80 yarn count (125 decitex) was used.

(4) Production of Woven Fabric

A woven fabric with a barathea structure shown in FIG. 6 was woven from the warp yarn 1, the weft yarn 1, and the weft yarn 2, using a rapier loom. The obtained woven fabric was dyed using acid dyes to dye the wool while increasing the temperature from room temperature (25°) to 100° C. over 75 minutes, immersed in hot water at 100° C. for 45 minutes, and then washed.

Comparative Example 2

The twisted union yarn of Comparative Example 1 was used as the weft yarn 1. The production was performed in the same way as that of Example 4, except for this aspect.

TABLE 1

| | Ex. 1 | Ex. 2 | Ex. 3 | Com. Ex. 1 |
|---|---|---|---|---|
| Yarn type | Fasciated spun yarn | Fasciated spun yarn | Fasciated spun yarn | Twisted union yarn |
| Core component conjugated filament yarn (mass %) | 30 | 30 | 33.3 | 33.3 |
| Sheath component wool (mass %) | 15 | 35 | 20 | 20 |
| Sheath component short PET fiber (mass %) | 55 | 35 | 46.7 | 46.7 |
| Metric count (yarn count) | 1/36 | 1/36 | 1/40 | 1/40 |
| Fluff count of 1 mm or longer | 55.9 | 84.9 | 121.9 | 144.0 |
| Breaking strength before hot water treatment (g) | 639.7 | 557.3 | 544.2 | 571.3 |
| Breaking elongation before hot water treatment (%) | 14.1 | 15.0 | 15.4 | 20.2 |
| Breaking strength after hot water treatment (g) | 602.4 | 494.7 | 526.5 | 496.0 |
| Breaking elongation after hot water treatment (%) | 19.2 | 19.1 | 20.3 | 20.3 |
| Hot water shrinkage rate (%) | 12.8 | 14.0 | 15.0 | 7.7 |
| Photo of appearance | FIG. 4 | FIG. 5 | — | — |

The conditions and results are summarized in Table 2.

TABLE 2

| Test item | | Ex. 4 | Com. Ex. 2 | Test method |
|---|---|---|---|---|
| Weft Yarn 1: metric count (yarn count) | | 1/40 | 1/40 | |
| Weft Yarn 2: metric count (yarn count) | | 1/40 | 1/40 | |
| Warp Yarn 1: metric count (yarn count) | | 2/80 | 2/80 | |
| Blending proportion | Wool (%) | 27.3 | 27.3 | |
| | Short PET fiber (mass %) | 63.7 | 63.7 | |
| | Conjugated yarn (mass %) | 9.0 | 9.0 | |
| Woven fabric structure | | Barathea | Barathea | |
| Mass (g/m$^2$) | | 224.6 | 227.6 | JIS L1096-8.3.2 (A method) |
| Yarn density | warp (number per 10 cm) | 420 | 402 | JIS L1096-8.6.1 |
| | weft (number per 10 cm) | 368 | 362 | |
| Tensile strength | warp (N) | 939 | 884 | JIS L1096-8.14.1 (A method) |
| | weft (N) | 836 | 719 | |
| Tensile elongation | warp (%) | 35.1 | 37.5 | JIS L1096-8.14.1 (A method) |
| | weft (%) | 55.6 | 50.9 | |
| Tear strength (D method) | warp (N) | 42.4 | 35.2 | JIS L1096-8.17.1 (A-2 method) |
| | weft (N) | 35.7 | 30.9 | |
| Surface abrasion (times) | | 377 | 306 | ASTM D3884-09 Taber method H-18 |
| Elongation (elasticity) | warp (%) | 2.5 | 3.1 | KES Texture measurement test (KES FB1) manufactured by Kato Tech Co., Ltd. |
| | weft (%) | 9.2 | 8.2 | |
| Change in dimensions (C method) | warp (%) | −0.2 | −0.5 | JIS L1096-8.39.1 (C method) |
| | weft (%) | −0.2 | −0.3 | |
| Change in dimensions after washing (104 method) | 15 times warp (%) | −1.1 | −1.7 | JIS L0217 (104 method) |
| | 15 times weft (%) | −0.4 | −0.2 | |
| | 15 times appearance (grade) | 5 | 5 | |
| Pilling (A method) | 10 h (grade) | 5 | 4-5 | JIS L1076-8.1.1 (A method) |
| | 20 h (grade) | 5 | 4-5 | |
| | 30 h (grade) | 5 | 5 | |

As is clear from Table 2, the woven fabric of Example 4 had high abrasion resistance, weft elasticity, and anti-pilling properties.

Industrial Applicability

A fabric produced from the multilayer structured spun yarn of the present invention is suitable for business suits, business uniforms, school uniforms, and the like. This fabric is also suitable for socks, gloves, whole garments, and the like.

LIST OF REFERENCE NUMERALS

1 Fasciated spinning apparatus
2, 2' Front roller
3 Second roller
4 Third roller
5 Back roller
6 Draft zone
7 Sliver
8 Sliver guide
9 Elastic multifilament yarn
10 Spindle
11 Multilayer structured spun yarn
12 Slab catcher
13 Friction roller
14 Take-up drum
15 Cradle arm
16 Package
20, 25 Multilayer structured spun yarn
21 Core component fiber
22, 26 Inner layer fiber
23, 27 Wound fiber
24, 28 Sheath component fiber
26*b* Wool in inner layer
26*b* Wool in inner layer
26*a* Short PET fiber in inner layer
27*b* Wool in outer layer
27*a* Short PET fiber in outer layer

The invention claimed is:

1. A multilayer structured spun yarn comprising: core component fibers; and sheath component fibers including inner layer fibers and outer layer fibers, wherein, in the sheath component fibers, the inner layer fibers are untwisted, and entirely bundled by the outer layer fibers wound therearound so as to be true-twisted in one direction in an S-twisted or Z-twisted manner, the core component fibers are an elastic conjugated multifilament yarn, the sheath component fibers are blended fibers containing animal hair fibers and short polyester fibers, a blending proportion of the animal hair fibers is 5 to 50 mass % with respect to 100 mass % of the multilayer structured spun yarn, and the animal hair fibers have an average fiber length of 20 to 35 mm.

2. The multilayer structured spun yarn according to claim 1, containing 10 to 40 mass % of the core component fibers and 60 to 90 mass % of the sheath component fibers with respect to 100 mass % of the multilayer structured spun yarn.

3. The multilayer structured spun yarn according to claim 1, wherein a single yarn of the multilayer structured spun yarn has a metric count in the range of 20 to 52 yarn count, and a fineness of 500 to 192 decitex.

4. A fabric comprising a multilayer structured spun yarn, wherein the multilayer structured spun yarn contains core component fibers, and sheath component fibers including inner layer fibers and outer layer fibers, in the sheath component fibers, the inner layer fibers are untwisted, and entirely bundled by the outer layer fibers wound therearound so as to be true-twisted in one direction in an S-twisted or Z-twisted manner, the core component fibers are an elastic conjugated multifilament yarn, the sheath component fibers are blended fibers containing animal hair fibers and short polyester fibers, a blending proportion of the animal hair fibers is 5 to 50 mass % with respect to 100 mass % of the multilayer structured spun yarn, and the animal hair fibers have an average fiber length of 20 to 35 mm.

5. Clothing comprising the multilayer structured spun yarn, wherein the multilayer structured spun yarn contains core component fibers, and sheath component fibers including inner layer fibers and outer layer fibers, in the sheath component fibers, the inner layer fibers are untwisted, and entirely bundled by the outer layer fibers wound therearound so as to be true-twisted in one direction in an S-twisted or Z-twisted manner, the core component fibers are an elastic conjugated multifilament yarn, the sheath component fibers are blended fibers containing animal hair fibers and short polyester fibers, a blending proportion of the animal hair fibers is 5 to 50 mass % with respect to 100 mass % of the multilayer structured spun yarn, and the animal hair fibers have an average fiber length of 20 to 35 mm.

* * * * *